US009533208B2

(12) United States Patent
Wright

(10) Patent No.: US 9,533,208 B2
(45) Date of Patent: Jan. 3, 2017

(54) SOCCER APPARATUS AND RELATED METHODS

(71) Applicant: Alan N. Wright, Northridge, CA (US)

(72) Inventor: Alan N. Wright, Northridge, CA (US)

( * ) Notice: Subject to any disclaimer, the term of this patent is extended or adjusted under 35 U.S.C. 154(b) by 0 days.

(21) Appl. No.: 14/573,365

(22) Filed: Dec. 17, 2014

(65) Prior Publication Data

US 2015/0111672 A1 Apr. 23, 2015

Related U.S. Application Data

(62) Division of application No. 13/346,114, filed on Jan. 9, 2012, now Pat. No. 8,932,157.

(51) Int. Cl.

| | |
|---|---|
| ***A63B 67/00*** | (2006.01) |
| ***A63B 63/00*** | (2006.01) |
| ***A63B 63/06*** | (2006.01) |
| ***A63B 69/00*** | (2006.01) |
| ***A63B 71/06*** | (2006.01) |
| ***A63C 19/00*** | (2006.01) |
| ***A63C 19/08*** | (2006.01) |
| *A63B 71/02* | (2006.01) |

(52) U.S. Cl.

CPC ..... *A63B 67/002* (2013.01); *A63B 63/00* (2013.01); *A63B 63/06* (2013.01); *A63B 69/002* (2013.01); *A63B 69/0097* (2013.01); *A63B 71/0605* (2013.01); *A63B 71/0619* (2013.01); *A63C 19/00* (2013.01); *A63C 19/08* (2013.01); *A63B 71/022* (2013.01); *A63B 71/0622* (2013.01); *A63B 71/0669* (2013.01); *A63B 2071/024* (2013.01); *A63B 2071/0625* (2013.01); *A63B 2207/02* (2013.01); *A63B 2208/12* (2013.01); *A63B 2220/801* (2013.01); *A63C 2019/085* (2013.01)

(58) Field of Classification Search

CPC ..... A63B 67/002; A63B 63/00; A63B 63/06; A63B 69/0097; A63B 2071/0625; A63B 2071/0694; A63C 2019/085

USPC ..... 273/398–402, 390–392, 371; 473/465, 473/469, 470, 476

See application file for complete search history.

(56) References Cited

U.S. PATENT DOCUMENTS

| | | | | |
|---|---|---|---|---|
| 2,580,799 | A * | 1/1952 | Lauterbach | A63B 63/00 473/476 |
| 4,284,277 | A * | 8/1981 | Leonard | A63B 67/002 473/471 |
| 4,352,497 | A * | 10/1982 | Warehime | A63B 67/002 273/127 R |
| 4,482,157 | A * | 11/1984 | McNeil | A63B 67/002 473/470 |
| 5,599,025 | A * | 2/1997 | Pobee-Mensah | A63B 67/002 473/471 |
| 7,011,310 | B2 * | 3/2006 | Rowan | A63B 63/00 273/398 |
| 2004/0058755 | A1 * | 3/2004 | Birks | A63B 67/002 473/415 |

(Continued)

*Primary Examiner* — Mark Graham

(74) *Attorney, Agent, or Firm* — John K. Buche; Bryce A. Johnson; Buche & Associates, P.C.

(57) ABSTRACT

Typical embodiments of the disclosed apparatus are: a traditional soccer ball; a game-play area that is confined within rebound-fences and pass walls; a vertical scoring standard that is configured to spin on a vertical axis when struck by a soccer ball. The identified apparatus may be used in a confined and multi-directional soccer game.

5 Claims, 5 Drawing Sheets

(56) References Cited

U.S. PATENT DOCUMENTS

| | | | | |
|---|---|---|---|---|
| 2007/0021241 | A1* | 1/2007 | Geller | A63B 63/004<br>473/415 |
| 2009/0291782 | A1* | 11/2009 | Hinn | A63B 63/00<br>473/470 |

* cited by examiner

SOCCER APPARATUS AND RELATED METHODS

CROSS-REFERENCE TO RELATED APPLICATIONS

This application is a divisional application of U.S. application Ser. No. 13/346,114 (filed Jan. 9, 2012) entitled "Soccer apparatus and related methods." The previous reference is hereby incorporated by reference.

STATEMENT REGARDING FEDERALLY SPONSORED RESEARCH OR DEVELOPMENT

Not applicable.

BACKGROUND OF THE INVENTION

1. Field of Invention

This application is in the field of sports apparatus and methods. Specifically, this application is in the field of soccer apparatus and related methods.

2. Background

Association football, colloquially "Soccer," is a traditional sport played between two teams of ten or eleven members. Soccer is played by kicking a ball over a rectangular field (typically 115 yards by 74 yards) with rectangular soccer goals at the opposite ends of the field. Each team defends their goal while simultaneously trying to kick the ball through the opponent's goal. Goals are tallied and the team with the most goals after a time period is declared the winner.

Soccer has become a popular sport in the United States and internationally. However, the field and goals of soccer are not configured for the full enjoyment of many soccer players. One disadvantage of traditional soccer is that the field is extremely large so that small teams of less than five cannot readily confine the game to a particular region of the field. As a result, a soccer game between small teams on a normal field can become stale in that competitive player vs. player interactions can be avoided by one team moving the ball into remote areas of the field. Another disadvantage of traditional soccer is that play is unidirectional toward either end of the field (i.e., goals are made by moving the ball through the plane of a rectangular goal positioned at the end of the field). Practically, missed goals are usually either knocked out of bounds or captured by the goalie; either way, game play is halted and can become discontinuous after every goal attempt. Also, missed goal attempts can result in the need to retrieve the ball from behind the goal at great distances. Accordingly, there is a need for soccer systems or games (including apparatus and related methods) without the aforementioned disadvantages.

Many soccer systems or games exist for use by fewer than five people. For example, some have attempted to confine the game area (by physical border or rules) or otherwise provide rebounding mechanisms to a soccer goal (see, e.g., U.S. Pat. No. 5,556,106 (issued Sep. 17, 1996), U.S. Pat. No. 5,346,228 (issued Sep. 13, 1994), U.S. Pub. Pat. App. Nos. 2011/0015002 (published Jul. 17, 2009), 2002/0022540 (published Feb. 21, 2002), 2011/0059819 (published Mar. 10, 2011), 2006/0089213 (published Apr. 27, 2006), 2010/0222162 (published Sep. 2, 2010), US 2008/0076606 (published Mar. 27, 2008), US 2011/0059815 (published Mar. 10, 2011), 2010/0022333 (published Jan. 28, 2008), 2009/0209372 (published Aug. 20, 2009), 2007/0142130 (published Jun. 21, 2007), and, 2007/0021241 (published Jan. 25, 2007); see also, e.g., U.S. Pub. App. Nos. 2009/0286630 (published Nov. 19, 2009) (now U.S. Pat. No. 7,775,912 (issued Aug. 17, 2010), 2008/0280702 (published Nov. 13, 2008), 2009/0264263 (published Oct. 22, 2009) for soccer rebound via leash) whereby soccer competitions between fewer individuals can remain competitive or without significant stoppages. For another example, some have provided portable or modified goals so that game play areas may be modified or shrunken (see, e.g., U.S. Pat. No. 6,607,455 (issued Aug. 19, 2003), U.S. Pat. No. 5,873,798 (issued Feb. 23, 1999), U.S. Pat. No. 6,811,501 (issued Nov. 2, 2004) U.S. Pub. App. No. 2008/0032826 (published Feb. 7, 2008), 2006/0264274 (published Nov. 23, 2006), 2009/0312124 (published Dec. 17, 2009), 2011/0105253 (published May 5, 2011), US 2010/0062880 (published Mar. 11, 2011), 2009/0258735 (published Oct. 15, 2009), 2009/0176603 (published Jul. 9, 2009), and 2009/0149281 (published Jun. 11, 2009)) whereby game-play can be confined to smaller fields or restricted to shots on goal. Finally, some have conceived of ways to make soccer game-play multi-directional (U.S. Pat. No. 7,614,968 (issued Nov. 10, 2009), U.S. Pat. No. 5,553,863 (issued Sep. 10, 1996), 2002/0022540 (published Feb. 21, 2002), 2002/0142867 (published Oct. 3, 2002), 2009/0291782 (published Nov. 26, 2009), 2011/0028249 (published Feb. 3, 2011)) instead of playable in a single direction. Although useful for their intended purpose, these soccer systems or games are not entirely satisfactory for removing the previously mentioned disadvantages.

Many of the above disclosed and known soccer systems or games are for training purposes and involve repetitive or boring drills rather than the ongoing fun of competitive play. Certainly, playing soccer requires a wide variety of skills including the ability to control and direct the ball on any number of body surfaces other than hands and arms, but when isolated, such skills are not yet ready for use in competitive situations. Unlike the soccer ball of many of the disclosed soccer training apparatus and methods, a soccer ball in actual competition can arrive from a variety of directions, speeds, and spins, and a player may be moving in any number of directions wherein control and direction of ball movement must be taken into consideration. Also, in competitive soccer, players must make on-the-spot decisions (e.g., choosing to direct the ball to others, dribble past an opposing player, or shoot or head the ball at the goal) which cannot be taught by many of the disclosed soccer systems or games. Accordingly, the identified references fail to provide soccer systems or games for use by fewer than five people without the identified disadvantages. The identified prior art references further fail to disclose suitable methods for incorporating an apparatus disclosed by this specification into a coherent or competitive game to be played between teams.

SUMMARY OF THE INVENTION

In view of the foregoing, it is an object of this specification to disclose apparatus and related methods of a confined, competitive and multi-directional soccer game. Typical embodiments of the disclosed apparatus are: a traditional soccer ball; a game-play area that is confined within rebound-fences and pass walls; a vertical scoring standard that is configured to spin on a vertical axis when struck by a soccer ball. The identified apparatus may be used in a confined and multi-directional soccer game via: (1) establishing the game-play area, wherein the rebound surfaces are positioned around the sides and the pass walls are positioned at the corners of the game-play area; (2) establishing the vertical scoring standard at a central location of the game-play area; (3) placing the ball within the game-play area; and (4) instructing a first team of fewer than five people to kick the ball against the vertical scoring standard (from any direction) in a manner that results in the scoring standard spinning on its vertical axis; and, (5) instructing a second team of fewer than five people to defend the cylinder from being struck by the ball. In an optional embodiment, both the first and second teams attempt to (a) kick the ball against the vertical scoring standard in a manner that results in the cylinder spinning on its vertical axis and (b) defend the cylinder against being struck by the ball directed thereto by the opposing team. Rules of traditional soccer regarding contact (e.g., the illegality of using one's hands) may be incorporated. Yet still, score can be kept via tallying the number of times each of the first and second teams kick the ball against the cylinder, wherein the team with the most scores after a period of time may be declared the winner.

It is further an object of this specification to disclose apparatus and related methods of a confined and multi-directional soccer game that are fun and competitive.

Yet still, it is an object of this specification to disclose apparatus and related methods of a confined and multi-directional soccer game that are fast paced, active, and that can be enjoyed by anyone from early childhood to older adult.

Another object of this specification is to disclose apparatus and related methods of a confined and multi-directional soccer game which provide soccer skill development in addition to the enjoyment of competitive play. The apparatus and methods disclosed herein suitably refine fundamental soccer ball handling skills during actual game-play and teach strategies of passing the ball to open players, shooting at goal, or dribbling. Also encouraged by the invention is movement by an off-the-ball player to receive a pass, which movement is essential to success in traditional soccer. The short game in traditional soccer makes extensive use of passing triangles to control team possession and to advance the ball to score as do the apparatus and methods disclosed herein.

Another object of this specification is to disclose apparatus and related methods of a confined and multi-directional soccer game which require neither a large number of players nor large field space. For instance, the apparatus and related methods disclosed herein may be used at home (e.g., in the back yard or the front driveway), at the local park, beach, or school yard.

Another object of this specification is to disclose apparatus and related methods of a confined and multi-directional soccer game which can be quickly set up.

BRIEF DESCRIPTION OF THE FIGURES

The manner in which these objectives and other desirable characteristics can be obtained is better explained in the following description and attached figures in which.

It is to be noted, however, that the appended figures illustrate only a typical embodiment of the invention. As a result, the figures are not to be considered limiting of the scope of the underlying invention. That is to say, the disclosed invention may admit to other equally effective embodiments that will be appreciated by those reasonably skilled in the relevant arts and the drawings are not necessarily drawn to scale.

DETAILED DESCRIPTION OF PREFERRED EMBODIMENTS

In general, disclosed are apparatus and related methods of a confined and multi-directional soccer game. Typical embodiments of the disclosed apparatus are: a traditional soccer ball; a square game-play area that is confined within rebound-fences and pass walls; a vertical scoring standard that is configured to spin on a vertical axis when struck by a soccer ball. The identified apparatus may be used in a confined and multi-directional soccer game via: (1) establishing the game-play area, wherein the rebound fence(s) are positioned around at least a portion of the perimeter of the game-play area and pass wall(s) are positioned at the corners of the game-play area; (2) establishing the vertical scoring standard at a central location of the game-play area; (3) placing the ball within the game-play area; and (4) instructing a first team of fewer than five people to kick the ball against the vertical scoring standard (from any direction) in a manner that results in the scoring standard spinning on its vertical axis; and, (5) instructing a second team of fewer than five people to defend the cylinder from being struck by the ball. In an optional embodiment, both the first and second teams attempt to (a) kick the ball against the vertical scoring standard in a manner that results in the cylinder spinning on its vertical axis and (b) defend the cylinder against being struck by the ball directed thereto by the opposing team. Rules of traditional soccer regarding contact (e.g., the illegality of using one's hands) may be incorporated. Yet still, score can be kept via tallying the number of times each of the first and second teams kick the ball against the cylinder, wherein the team with the most scores after a period of time may be declared the winner. The apparatus and related methods disclosed herein have been dubbed, for purposes of this specification, Spin soccer. More specific aspects of the disclosed apparatus and methods are disclosed in connection with the appended figures.

A. Basic Spin Soccer—Apparatus and Rules of Play

1. Apparatus

Figure 1:
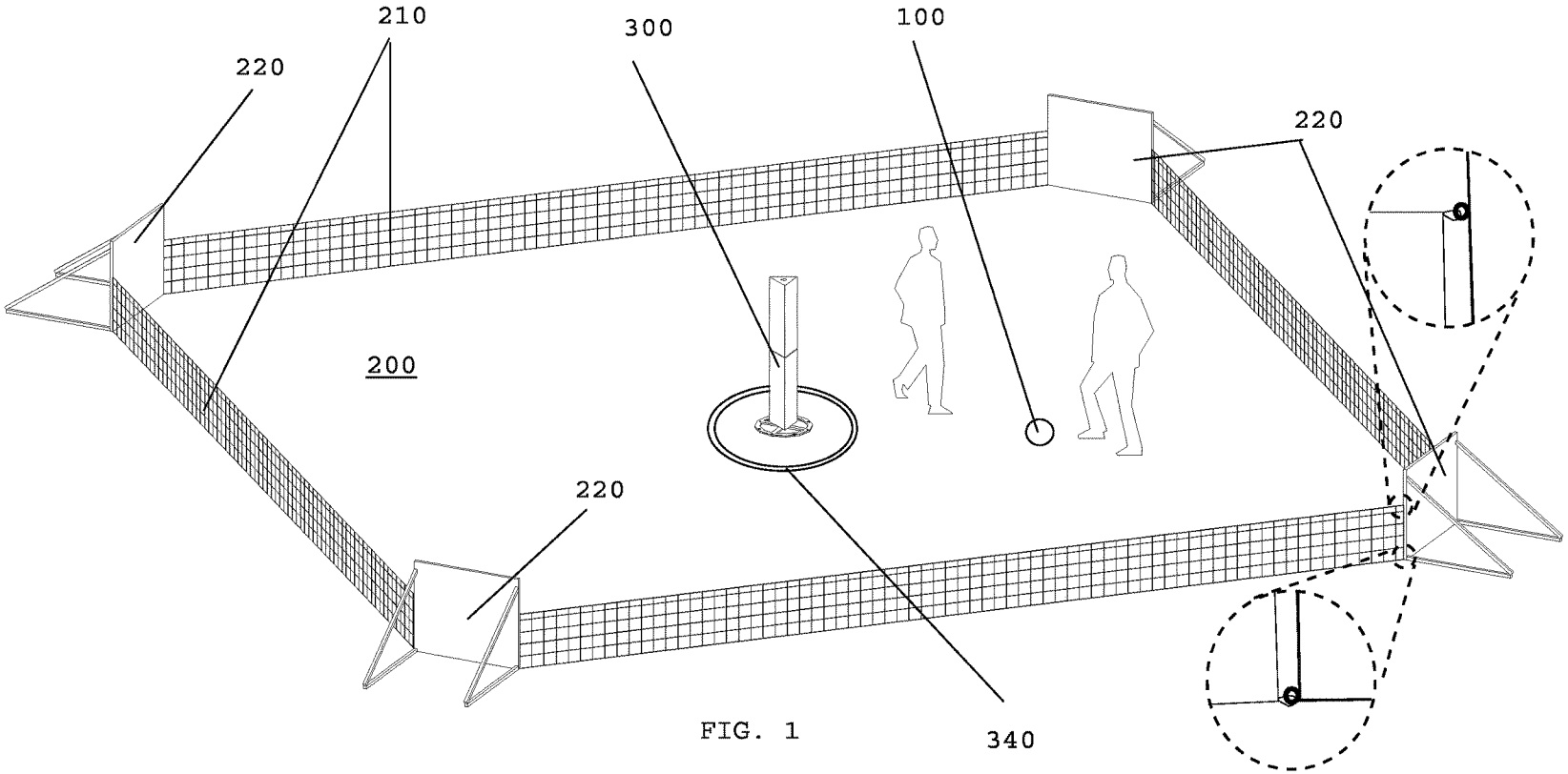
FIG. 1. Is a perspective view of a Spin soccer game play area 200.

FIG. 1 shows the layout and basic apparatus of the Spin soccer game. As shown in the figure, the apparatus include: a traditional soccer ball 100; a square game-play area 200 that is confined within four sections of rebound-fencing 210 and four pass walls 220 located at the corners of the game-play area 200; a vertical scoring standard 300 that is configured to spin on a vertical axis when struck by the soccer ball 100; and a boundary 340 line around the scoring standard 300.

Figure 3:
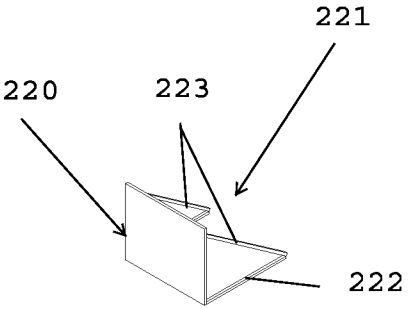
FIG. 3 is a perspective view of a pass wall 220.
Figure 2:
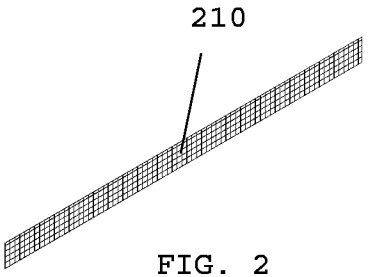
FIG. 2 is a perspective view of fencing 210.

FIG. 1 depicts the game play area 200. Preferably, the game-play area is generally square (thirty-six feet by thirty-six feet (side to side)). The game play area 200 is suitably confined by four sections of rebound fencing 210 on its edges and four pass walls 220 at its corners. FIGS. 2 and 3 respectively depict a typical section of the rebound-fencing 210 and a typical pass wall 220. Referring first to FIGS. 1 and 2, each section of fencing 210 is preferably shown as a rectangle (twenty-four feet, two and a half inches in length by one foot, six inches in width) of netting (which may be customary for traditional soccer goals). In one embodiment, the fencing 210 may be: made of quality nylon or polypropylene netting designed for heavy play with chord diameter of three millimeters and with mesh squares of approximately three inches; made with an extra-heavy white plastic top binding sewn with three rows of stitching (or other methods for creating a long-lasting net configuration); and, made with a sewn nylon sleeve at the base of the net. As shown in FIG. 1, the fencing 210 may suitably be held fast between two pass walls 220, wherein the fencing 210 is in upstanding elastic tension along the edges of the game play area 200. Suitably, the tension should be sufficient to restrain a kicked soccer ball from moving outside of the game play area. To accomplish the tension: the fencing 210 may be secured with a three-sixteenths of an inch of polypropylene cord with a termination loop that runs through the white plastic top binding described above; and, the bottom of the fencing is secured with a three-sixteenths of an inch of cable with a termination loop, wherein the cable runs horizontally through the sewn nylon sleeve at the base of the net.

Figure 1A:
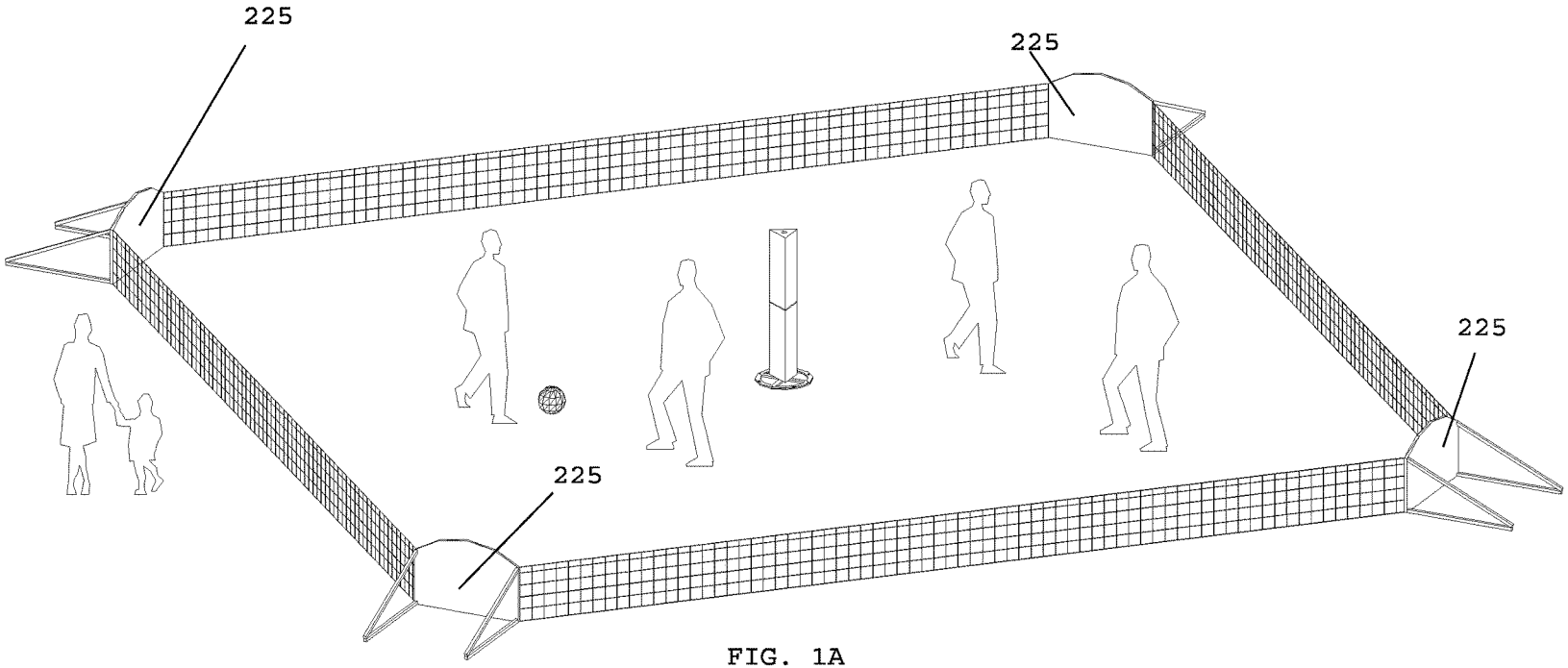
FIG. 1A is a perspective view of an alternate embodiment of the Spin soccer game play area 200.

Referring now to FIGS. 1 and 3, a pass wall 220 may be a rectangular (two feet in height by three feet in width) board attached to an anchor system 221. The four pass walls 220 may be suitably fixed in each corner of the game play area 200. In another preferable embodiment 225 of the pass wall (shown in FIG. 1A), the tops of the walls may be rounded (the rounded top suitably removes sharp corners), wherein the face of the board may be two vertical feet from base to the center point of the rounded top and the outside edge of the semi-circular shape drops to 18" at the corner vertical measurement. Other embodiments of the pass wall may demonstrate variations of this design.

The pass walls 220 may be considered part of the game play area 200 and are fixed with an anchor system 221 so that the walls 220 remain in a fixed in position when a ball is kicked into contact therewith. The anchor system 221 for stabilizing the pass wall 220 preferably features one of three designs. The appropriateness of the anchor system 221 design depends on the environmental conditions of the game play area 200. The first design is shown in FIG. 3 and comprises two basic rigid right-triangular brackets which may be collapsible, wherein each bracket consists of: a horizontal member 222 that is perpendicular to the face of the board and is affixed at ground level to the rear of the board (extending to the out of play area); and, a forty-five degree bracket which extends from the rear of the ground level bracket and is attached midway on the pass wall 220. A second design for an anchor system 221, not shown in the figures, comprises ground stakes extending from the bottom of the wall 220, wherein the stakes are designed for either sand surfaces or traditional soil surfaces, two on each side. A third design for the anchor system 221 (not shown) may be for hard surface game play areas (e.g., cement, asphalt, or similar interior and exterior hard play surfaces) and is defined by roto-molded plastic container that is filled with water (or sand) to provide anchoring.

As alluded to above with reference to FIG. 1, the pass wall 220 is also a support for holding the fencing 210 upstanding in elastic tension. For this purpose, the fencing 210 may be secured to the pass wall 220 through a quick link connection which connects termination loops of (a) the top cord (nylon or wire) in the top binding and (b) the bottom chord in the sleeve to a hinged flat eyebolts on the side of the pass wall 220. That is to say: each pass wall 220 may have four flat eyebolts that are used to attach the cord termination loops from the boundary net at ground level and at the top height level on both sides of the pass wall 220.

Referring once again to FIG. 1, the scoring standard 300 may be established at central location of the game-play area 200. As stated above, the scoring standard 300 is configured to spin when struck by a soccer ball. FIGS. 4A, 4B, 4C, and 4D respectively depict on embodiment of such "spinning" configuration. As shown in FIG. 4A, the scoring standard 300 features a base 310, an axial shaft 320, and a collar 330. As shown in FIG. 4B, the base 310 may be defined by a metal plate 311 with an upstanding receptacle 312. FIGS. 4B and 4C illustrate that the receptacle 312 may be configured to coaxially receive the axial shaft 320. The height of the axial shaft 320 may be eight feet. The shaft is configured to be telescopically expansible or collapsible and may be held in an expanded state via spring loaded pins (not shown). Suitably, the receptacle 312 may be defined by a bearing swivel to facilitate rotation of the axial shaft 320 therein. Referring now to FIG. 4D, the collar 330 may be defined by two sections of foam defining equilateral triangular prisms 331 with apertures 332 disposed therethrough their center along their lengths, wherein the two prisms 331 are alignedly held together by a molded plastic equilateral triangular plate 333 with a similarly positioned aperture 334 and alignment pegs 335 which are adapted to fit into alignment sockets 336 on the interface of the prisms 331. The assembled collar 330 may suitably be covered by a thin and colorful spandex or other nylon product sleeve (not shown). Referring again to FIG. 4A, the apertures 332, 334 may be run through via the axial shaft whereby the collar 330 may spin therearound after being struck by a soccer ball. The scoring standard 300 can be anchored to a dirt or sand area with stakes through the plate which may operate to hold the scoring standard 300 in place. Suitably, the dimensions of the sections of the triangular prisms 331 of the collar 330 may preferably either be: (1) for adults, four feet tall by eight and sixty-five hundredths inches by eight and sixty-five hundredths inches by eight and sixty-five hundredths inches; or (2) for children, four feet tall by seventeen and one-fifth inches. The larger collar 330 will create a higher incidence of successful hits for the younger (less skilled) players. Although disclosed as a triangular prism, the scoring standard collar may be of any prism shape, including cylindrical.

Figure 4F:
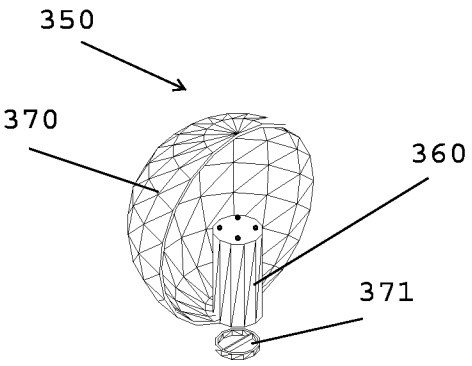
FIG. 4F is an cross-sectional view of the alternate embodiment of the scoring standard 300.
Figure 4E:
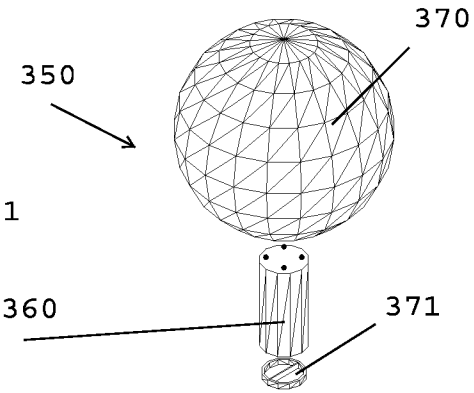
FIG. 4E is an exploded view of an alternate embodiment of the scoring standard 300.
Figure 4D:
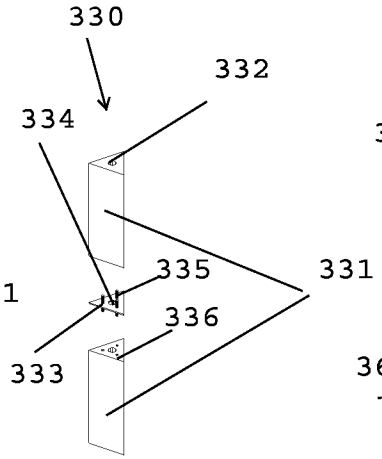
FIG. 4D is an exploded view of the coverings of the scoring standard 300.
Figure 4C:
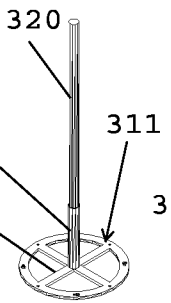
FIG. 4C is a perspective view of the interior of the scoring standard 300.
Figure 4B:
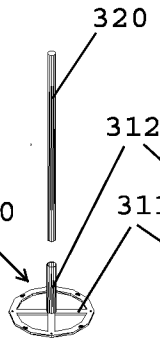
FIG. 4B is an exploded view of the interior of the scoring standard 300.
Figure 4A:
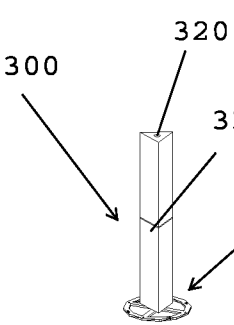
FIG. 4A is a perspective view of the scoring standard 300.

FIGS. 4E and 4F respectively illustrate exploded and cross-section views of an alternate embodiment 350 of the scoring standard 300 of FIGS. 4A through 4D. The alternate scoring standard 350, instead of being configured to spin, may be configured to electronically sense contact with the ball. Also, instead of a triangular prism the electronic scoring standard may be a cylindrical, spherical or other shape. As shown, the alternate scoring standard 350 features: an upright cylinder 360 with external LED lights connected to a "shake switch" and battery source; a translucent plastic orb 370 with a base 371 that is positioned therearound the upright cylinder 360. Preferably, the alternate scoring standard utilizes shake switches or other technology of sensors that will indicate when the scoring device has been hit by a ball during play (such other technology is disclosed by U.S.

Pub. Pat. App. No. 2009/0291782 (published Nov. 26, 2009)). In one embodiment, orb 370 of the alternate scoring standard 350 may be twenty two centimeters in diameter (roughly the size of a soccer ball) and may be constructed from a solid piece of translucent roto-molded plastic with an integrated base. Each time the electronic scoring standard 350 is struck by a soccer ball, a series of digitally displayed lights may flash at the top of the pole creating the effect of a spinning light. The electronic scoring standard 350 may also feature an audio track plus sound producing means that will engage to further indicate contact between a ball and the scoring standard. Such an audio track may suitably have a silence or mute option whereby the visual a digital display may electively be the only indication of ball contact with the scoring standard. The electronic scoring standard 350 may be further equipped with a digital score card system that is activated by a push button so that players can conveniently keep team scores on the device. Such electronic scoring standard 350 may further feature software on computer readable memory that is coupled to computer hardware, wherein said software is configured to track scores during games as well as over a season for a single team or a plurality of teams.

Referring once again to FIG. 1, the boundary line 340 suitably represents an off-limits area immediately surrounding the scoring standard 300. In one embodiment, the boundary line is a flat plastic hoop (or other similar item) measuring thirty-six inches in diameter. The boundary line 340 may be placed around the scoring standard 300 as if the scoring standard 300 is the center point of the hoop. As discussed in further detail below, players are not allowed in this space during a Spin soccer game in order to keep the game pace from being slowed by a defensive strategy that simply tries to deflect offensive shots-at-the-scoring-device rather than defenders playing one-on-one defense in the other parts of the game-play area 200.

2. Rules of Play

Operably, the apparatus, when configured as shown in FIG. 1, may be used in a confined and multi-directional Spin soccer game. Two teams of fewer than five members may be positioned in the game play area with a soccer ball 100 (most preferably, team sizes can vary from one-on-one or two-on-two (or three-on-three, if the court dimensions are expanded to forty-eight feet by forty eight feet (from side-to-side))). The two general objectives of the game for either team are: (1) when in control of the ball, to strike or shoot the vertical scoring standard 300 with the ball 100 (e.g., via kicking or heading) in a manner which results in the spinning of the collar 330 (or the electronic recordation of contact); or (2) when out of control of the ball, to defend the scoring standard 300 from contact with the ball 100. Thus, score may be kept by tallying one point for every instance in which the team strikes the scoring standard 300 as described above. Suitably, a scoring strike should result in spinning of the collar 330 of the scoring standard to clearly identify that a score has been made. Teams can play for a designated time period such as 20 minutes and the team with the highest score wins. Otherwise the team can designate a score threshold such as 5 points and teams play until one team achieves five points first. Variations in scoring systems can be utilized to enhance play for specific groups.

In one embodiment shown in FIG. 1, play may begin with: one team (the offensive team) being placed in control of or possessing the ball 100 at the edge of the game play area 200; and, the opposing team (defending team) positioned for defending the scoring standard 300. The offensive team can pass the ball 100 over the game play area 200 either directly between team members or via ricochet off of the rebound fencing 210 or pass walls 220. Shots on the scoring standard 300 (e.g., by kicking or by heading) are allowed at any time by the offensive team. When a score is made, the defending team is granted control of the ball 100 at the edge of the game play area 200, at which point the defending team becomes the offensive team and vice versa, and the game continues. However, if a member of the defending team takes (colloquially "steals") the ball 100 from the offensive team before a score is made, the defending team does immediately become the offensive team via its possession of the ball; instead, the defending team ball 100 must contact one of the rebound 220 walls with the ball while still in possession thereof before switching to offensive (for purposes of shooting the ball at the goal).

In the embodiment of FIG. 1, whenever the ball travels outside of the area 200 of play, e.g., over the rebound fencing 210 or pass walls 220, the team to last touch the ball surrenders possession of the ball 100 to the opposing team and play resumes, as outlined above. Preferably, game play resumes by the new offensive team placing the ball 100 on the ground near the fencing 210 or rebound wall 220. Suitably, play may begin as soon as a member of the offensive team touches the ball 100. Members of the defending team should remain a minimum of 18 inches away from the ball 100 until a member of the offensive team touches the ball with their foot. The ball 100 must be put into play as soon as possible. Delays of more than 7 seconds from the placement of the ball on the ground should result in the possession of the ball being reversed to the other team (i.e., the defensive team becomes the offensive team and vice versa).

Yet still referring to the embodiment depicted in FIG. 1, a boundary 340 (e.g., in the form of a circle) may be placed around the scoring standard 300. Suitably, members of the defensive team must remain outside the boundary. Conversely, members of the offensive team may pass through the boundary zone, but the ball 100 may not be advanced to a player within the boundary 340. To wit, if the ball 100, during game-play, should stop moving within the boundary 340, then play may be resumed by dropping the ball between two opposing players in front of one of the pass walls 220, wherein possession is awarded to the team that is able to control the ball 100 after the free drop.

The traditional rules of soccer governing individual play outlined in the FIFA rules or other governing soccer organizations are also the standard for fair play in Spin soccer. An example of an individual play based rule of the soccer would be: no unsportsmanlike conduct (demonstrated by kicking, tripping, charging, jumping, spitting at or striking another player). In the case of an infraction related to unsportsmanlike play by a player from one team, the opposite team gets the equivalent of a penalty kick. The penalty kick is taken with the ball placed 3 feet in front of the nearest pass wall to the infraction. Opposing players must stand behind the scoring standard 300 and outside the boundary 340 while the penalty kick is being made. Should the penalty kicker miss the scoring standard 300, play resumes immediately with the contested ball being free for possession by either team. Other infractions are also policed under the traditional rules. For instance: hand balls, obstruction, holding, or dangerous play result in the aggrieved team being awarded possession of the ball 100 in front of the nearest pass wall 220 for a penalty kick. Under such circumstances, defensive players should stand five feet away from the soccer ball until the offensive player touches the ball 100 and play resumes. In preferable embodiments, said penalty kicks are considered "direct kicks" (i.e., scoring can be immediate by the penalty kicker).

B. Variations in Spin Soccer Apparatus and Rules of Play (Variations in Play)

The apparatus may also be used in different variations of a confined and multi-directional Spin soccer game. The basic objectives preferably remain the same, namely to either (a) kick or head the soccer ball into a scoring standard 300 or (b) defend the scoring standard 300 against contact from the ball. The configuration of the apparatus may be varied to result in said spin soccer variations.

1. Free Play:

In the Free Play variation, competing teams play Spin soccer without establishing the fencing 210 or pass walls 220 of FIG. 1. Instead, the teams target or defend the scoring standard 300 without an outside boundary. In Free Play, whenever a ball is directed toward the scoring standard 300 without contact therewith (i.e., a missed score attempt), possession of the loose ball may be contested by the two teams, and the team to gain possession immediately becomes the offensive team; whenever an offensive team scores, the defending team is awarded possession of the ball at least eighteen feet from the scoring standard (i.e., the defensive team becomes the offensive team and vice versa); whenever the defending team steals the ball from the offensive team the defending team must first establish possession of the ball beyond eighteen feet from the scoring standard 300 before the defensive and offensive teams exchange roles. All other rules of the standard Spin soccer game would apply.

2. Rebound Play:

In Rebound Play, competing teams play Spin soccer with a different apparatus configuration than that shown in FIG. 1. Once again, the basic objectives of the game remain the same. However, offensive play can be enhanced with various configurations of the pass walls 220 or natural rebound surfaces (e.g., a building wall) which allow for ricochet passing. To wit, the rebound surfaces increase the short play passing options for the offensive team. The basic rules of the game for Free Play are followed but naturally existing rebound surfaces and/or pass walls 220 are introduced in order to create passing options for the team.

Figure 5:
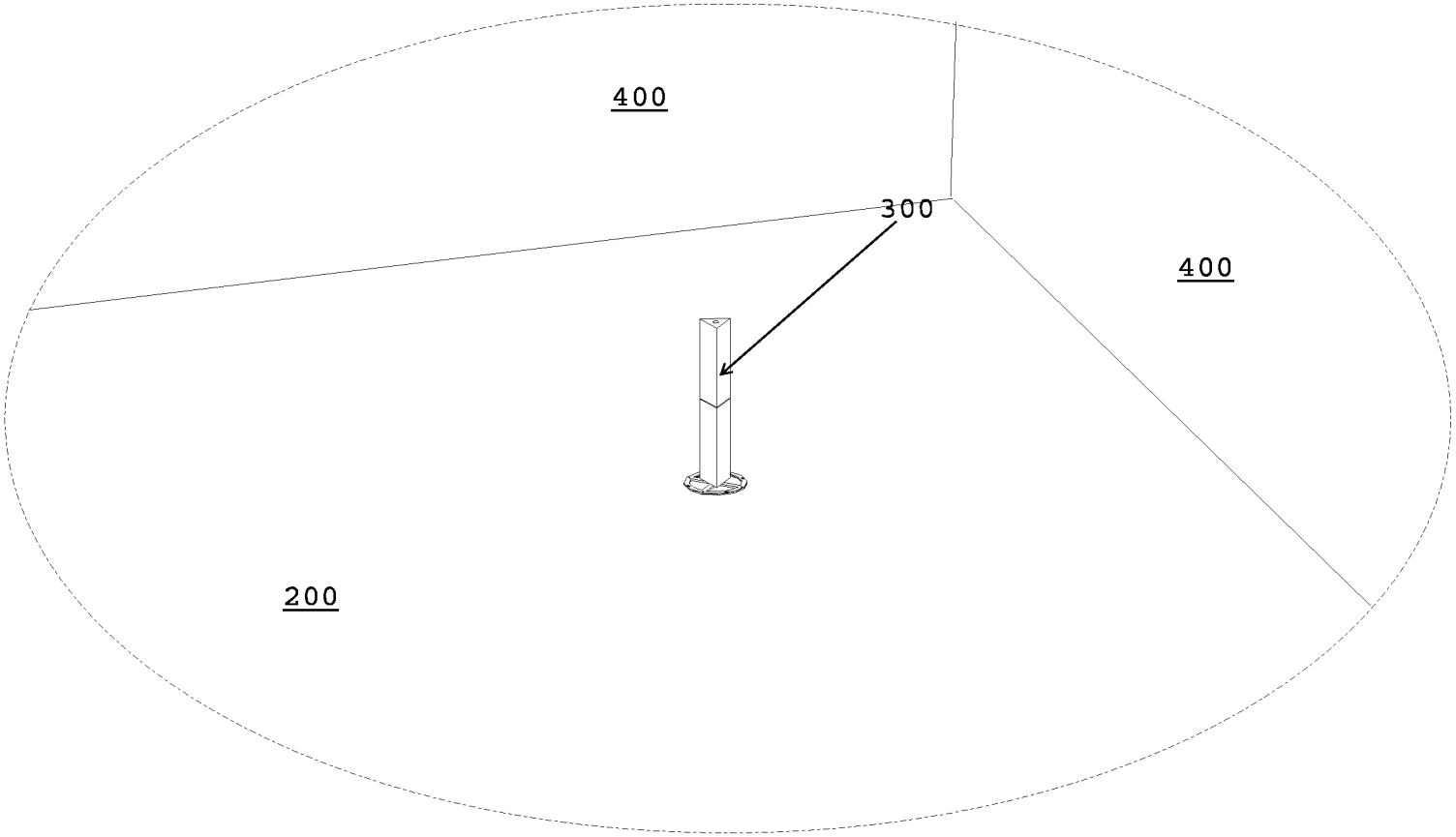
FIG. 5 is a diagram of Rebound Play Spin soccer.
Figure 6:
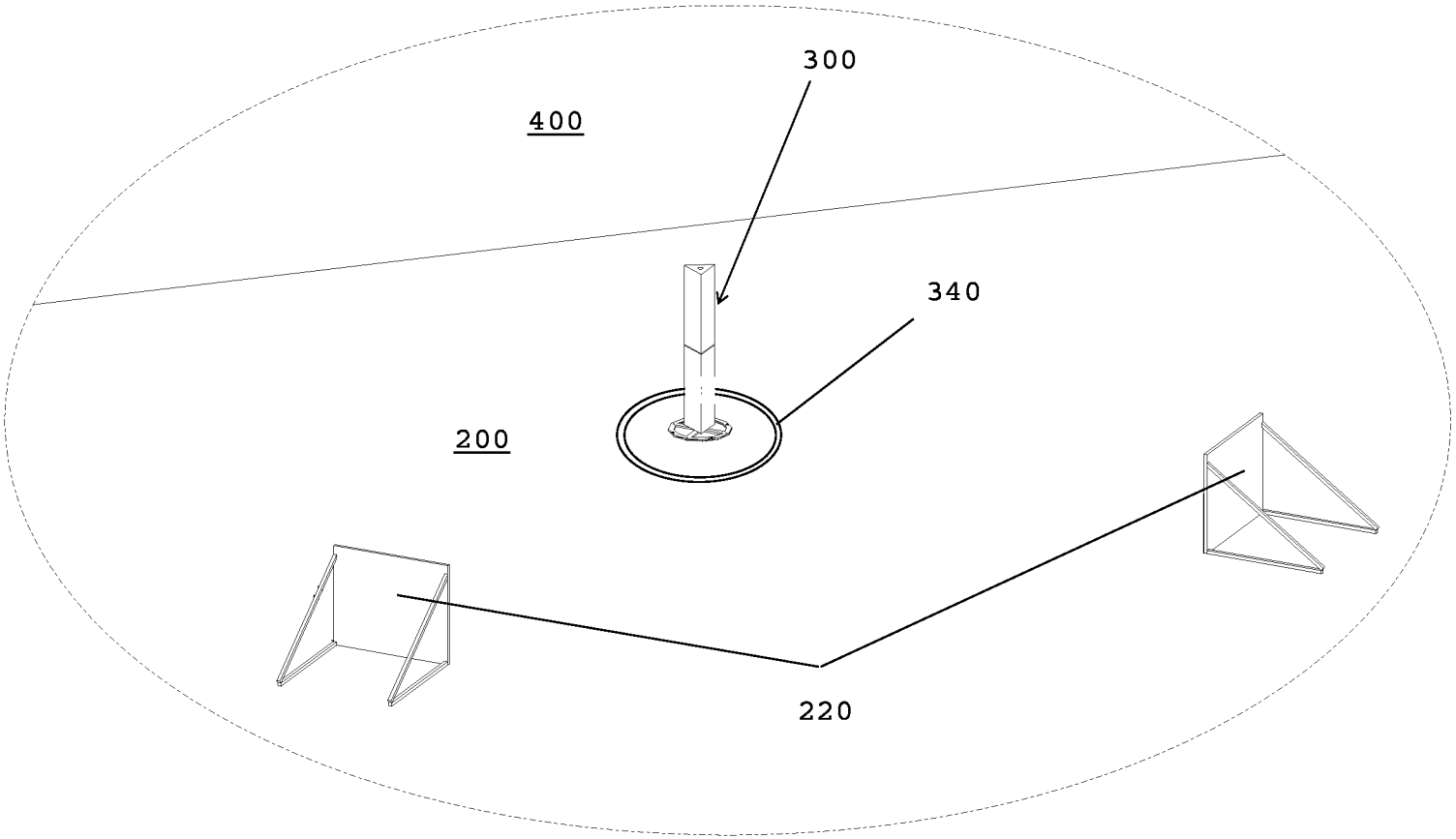
FIG. 6 is another diagram of Rebound Play Spin soccer.

FIGS. 5 and 6 show two examples of Rebound Play. In FIG. 5, natural rebound surfaces 400 create a ninety degree corner. Rebound Play may incorporate the apparatus of Spin soccer via positioning the scoring standard 300 at least fifteen feet away from the natural rebound surface 400 corner, wherein Free Play Spin soccer engages for three hundred and sixty degrees around the scoring standard. In FIG. 6 an uncornered natural rebound surface 500 plus two pass walls 220 are shown being incorporated into Rebound Play. When configured as shown in FIG. 5, Free Play Spin soccer may be played around the scoring standard 300 wherein the rebound surface 500 plus the two pass boards 220 may act as pass points for either team. Other similar variations of Rebound Play can be created according to the principles shown in FIGS. 4 and 5.

This specification and the appended figures illustrate only typical embodiments or principles disclosed in this application, and therefore, are not to be considered limiting of its scope, for the invention may admit to other equally effective embodiments that will be appreciated by those reasonably skilled in the relevant arts. Any invention disclosed by this specification is defined by the claims.

I claim:

1. A method of playing a sports game comprising the steps of:

establishing a sports field comprising:

a game play area;

at least one pass wall facing at least a portion of the game play area;

at least one section of fencing supported by said pass wall, wherein said fencing and said pass wall(s) define at least one edge of the game play area wherein the fencing is made of netting, whereby a ball that is kicked into the net will rebound into the game play area; and, a scoring standard at a central position within said game play area, wherein the scoring standard is designed to be struck by a ball that has been kicked;

wherein said fencing is secured to the pass wall by at least one cable with a termination loop;

wherein said fencing is secured with the at least one cable with the termination loop that runs through a binding, and the bottom of the fencing is secured with another cable that has another termination loop and that runs through a sewn nylon sleeve at the base of the net;

introducing a player to within the sports field;

introducing a sports ball to within the sports field; and, directing the player to contact the scoring standard with the ball.

2. The method of claim 1 wherein the scoring standard comprises:

an axial shaft;

a base with a receptacle defined at least in part by a bearing swivel, wherein said receptacle is configured to rotatably receive the axial shaft;

a collar secured around said axial shaft; and, wherein said scoring standard, when assembled, is configured to spin about the axial shaft in response to contact with a sports ball to alert the players that a point has been scored.

3. The method of claim 1 wherein the scoring standard comprises:

an electronic means for sensing contact with a sports ball; and, a visual display means for presenting an indication of contact between the scoring standard and a soccer ball.

4. The method of claim 1 wherein the sports field further comprises:

a natural rebound surface.

5. The method of claim 3 wherein the sports field further comprises:

a natural rebound surface.

* * * * *